US005842237A

United States Patent [19]

Hargest et al.

[11] Patent Number: 5,842,237

[45] Date of Patent: Dec. 1, 1998

[54] CONVERTIBLE BED/CHAIR WITH WASTE DISPOSAL

[75] Inventors: Thomas S. Hargest, Charleston; Bart T. Blackwell, Greenville; Adrian M. Moss, Summerville, all of S.C.

[73] Assignee: Lotecon, LLC, North Charleston, S.C.

[21] Appl. No.: 601,997

[22] Filed: Feb. 15, 1996

[51] Int. Cl.[6] ..... A61G 7/02

[52] U.S. Cl. ..... 4/449; 4/446; 5/605; 5/606; 5/928

[58] Field of Search ..... 4/420.1, 420.2, 4/420.3, 420.4, 420.5, 443, 449, 444, 445, 446, 447, 448, 598, 603; 5/928, 604, 605, 606

[56] References Cited

U.S. PATENT DOCUMENTS

| | | | |
|---|---|---|---|
| 801,117 | 10/1905 | Stow . | |
| 1,589,889 | 6/1926 | Mas et al. . | |
| 1,682,266 | 8/1928 | Daggy . | |
| 2,749,558 | 6/1956 | Lent et al. . | |
| 3,216,026 | 11/1965 | Mann . | |
| 3,220,020 | 11/1965 | Nelson . | |
| 3,220,021 | 11/1965 | Nelson . | |
| 3,262,133 | 7/1966 | Beitzel . | |
| 3,278,952 | 10/1966 | Holm . | |
| 3,312,985 | 4/1967 | Callaghan . | |
| 3,336,606 | 8/1967 | Beitzel . | |
| 3,402,408 | 9/1968 | Hutt . | |
| 3,422,985 | 1/1969 | Rinehart . | |
| 3,521,311 | 7/1970 | Cohen . | |
| 3,724,004 | 4/1973 | Behrens . | |
| 3,798,686 | 3/1974 | Gaiser . | |
| 3,878,572 | 4/1975 | Ericksson . | |
| 3,922,735 | 12/1975 | Kato | 4/420.2 |
| 3,943,583 | 3/1976 | Ishikawa | 5/605 |
| 3,958,283 | 5/1976 | Adams et al. . | |
| 4,039,363 | 8/1977 | Robertson . | |
| 4,094,024 | 6/1978 | Benoit et al. . | |
| 4,425,676 | 1/1984 | Crane . | |
| 4,472,848 | 9/1984 | Newman . | |
| 4,638,514 | 1/1987 | Landsberger | 4/420.4 |
| 4,694,520 | 9/1987 | Paul et al. . | |
| 4,791,686 | 12/1988 | Taniguchi et al. | 4/420.4 |
| 4,821,348 | 4/1989 | Pauna . | |
| 4,828,709 | 5/1989 | Houser et al. | 4/598 |
| 4,833,457 | 5/1989 | Graebe, Jr. . | |
| 4,920,587 | 5/1990 | Kerr . | |
| 4,955,090 | 9/1990 | Stefan . | |
| 4,977,629 | 12/1990 | Jones . | |
| 4,995,124 | 2/1991 | Wridge, Jr. et al. . | |
| 5,033,130 | 7/1991 | Dehaese . | |
| 5,058,222 | 10/1991 | Workman . | |
| 5,077,845 | 1/1992 | Tokunaga et al. . | |
| 5,090,067 | 2/1992 | Cogdill | 4/420.2 |
| 5,189,745 | 3/1993 | Workman et al. . | |
| 5,342,583 | 8/1994 | Son | 4/420.2 |
| 5,350,369 | 9/1994 | Workman et al. | 4/484 |
| 5,504,948 | 4/1996 | Chandler | 4/420.4 |
| 5,647,090 | 7/1997 | Yang | 4/443 |

FOREIGN PATENT DOCUMENTS

| | | |
|---|---|---|
| 94 18 386 | 2/1995 | Germany . |
| 984604 | 2/1965 | United Kingdom . |
| 2022995 | 12/1979 | United Kingdom . |
| 2219198 | 12/1989 | United Kingdom . |
| WO 82/03171 | 9/1982 | WIPO . |
| WO 92/03994 | 3/1992 | WIPO . |

*Primary Examiner*—Charles R. Eloshway
*Attorney, Agent, or Firm*—Leatherwood Walker Todd & Mann, P.C.

[57] ABSTRACT

A bed for patient care having a waste disposal system. The bed includes a back, seat and two leg sections for supporting the patient. These sections of the bed may be raised and lowered and tilted. The leg sections may be moved independently for use with patients having one leg immobilized. The seat section includes two panels which part to permit a waste canister to be raised to interface with the buttocks of the patient. An audible signal alerts the patient prior to this action. The waste canister provides a directable bidet wash, and an air drying feature. Gelling material within the canister swells during the bidet function to cover and seal the waste. The entire canister may be sealed and disposed of.

6 Claims, 5 Drawing Sheets

CONVERTIBLE BED/CHAIR WITH WASTE DISPOSAL

BACKGROUND OF THE INVENTION

1. Field of the Invention

The present invention relates in general to patient care beds. In particular, the present invention relates to an improved patient care bed convertible between a bed and a chair position, and a waste disposal system incorporated therein.

2. Description of the Related Art

In the field of patient care, there have been various attempts to provide patient beds which provide increased comfort and convenience. To this end, such beds often permit the back and/or leg sections of the bed to be raised and lowered. Examples of such arrangements are shown in U.S. Pat. Nos. 3,216,026, 3,220,020, and 3,278,952. Additionally, there have been beds which allow such movement to continue to a sufficient extent that the bed takes the form of a chair. Examples of these arrangements are shown in U.S. Pat. Nos. 4,920,587, 5,189,745, and 5,350,369. In the latter two patents, the bed, in the chair position, may be used in a similar manner to a wheel chair.

A further effort to increase convenience and comfort has resulted in some beds providing waste disposal to accommodate the bodily functions of the user. The three patents noted immediately above provide examples of such systems. Further examples are found in U.S. Pat. Nos. 801,117 and 1,589,889.

With these prior art systems, the beds have typically been complex apparatus. While the desired range of movement of the bed requires a certain amount of physical complexity, the operation of the beds (at least beyond the basic raising and lowering functions) has been rather complicated also. Additionally, where waste disposal has been provided, there has been little done in the way of cleansing the patient, or the arrangements for such cleansing have been rather complex. Even where a cleansing system has been provided, this complexity has not resulted in ease of use.

The need to treat such waste as a biohazard has also been a relatively recent development. At least one prior art system (the above-noted U.S. Pat. No. 5,350,369) does permit sealing of the waste collection unit. However, this collection unit is relatively complicated, and therefore expensive.

A further consideration is the odor produced by the bodily waste of the patient. One solution is to remove the waste immediately, yet this results in a large number of waste containers and a proportional waste of packaging material. The collection unit of the U.S. Pat. No. 5,350,369 patent permits multiple uses by solidifying the waste with a deodorizing gelling material. However, the construction of the collection unit of that patent often results in the fecal matter sliding upon the sides of the container. This may leave an odorous residue which is not gelled.

SUMMARY OF THE INVENTION

An object of the present invention is to provide a bed for patient care which provides a wide range of movement of the various bed sections.

Another object of the present invention is to provide such a bed which may be adjusted for height, Trendelenburg, reverse Trendelenburg, back and leg motion sufficient to place the bed in a chair position.

A further object of the present invention is to provide such a bed with a separate leg support section for each leg of the patient, with each leg section being independently controllable for movement.

Yet another object of the present invention is to provide a bed for patient care which includes a waste disposal system.

A further object of the present invention is for such a waste disposal system to provide multiple uses without creating an odor problem.

A further object of the present invention is to provide such a waste disposal system which provides for convenient cleansing of the patient.

Another object of the present invention is to provide a method of cleansing a patient after defecation.

Yet a further object of the present invention is to provide such a waste disposal system which is readily disposable yet maintains the waste sealed against egress.

Yet another object of the present invention is to provide such a bed for patient care in which the operating controls are simple and convenient.

A further object of the present invention is to provide such a bed in which the operation of the waste disposal system is safe and efficient.

These and other objects are achieved by a bed for patient care having a waste disposal system. The bed includes a back, seat and two leg sections for supporting the patient. These sections of the bed may be raised, lowered, and tilted. The leg sections may be moved independently for use with patients having one leg immobilized. The seat section includes two panels which separate to expose an aperture permitting a waste canister to be raised into engagement with the buttocks of the patient. An audible signal is alerts the patient prior to this action. The waste canister provides a directable bidet wash, and an air dry feature. Gelling material within the canister swells during the bidet function to cover and seal the waste. The entire canister may be sealed and disposed of.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
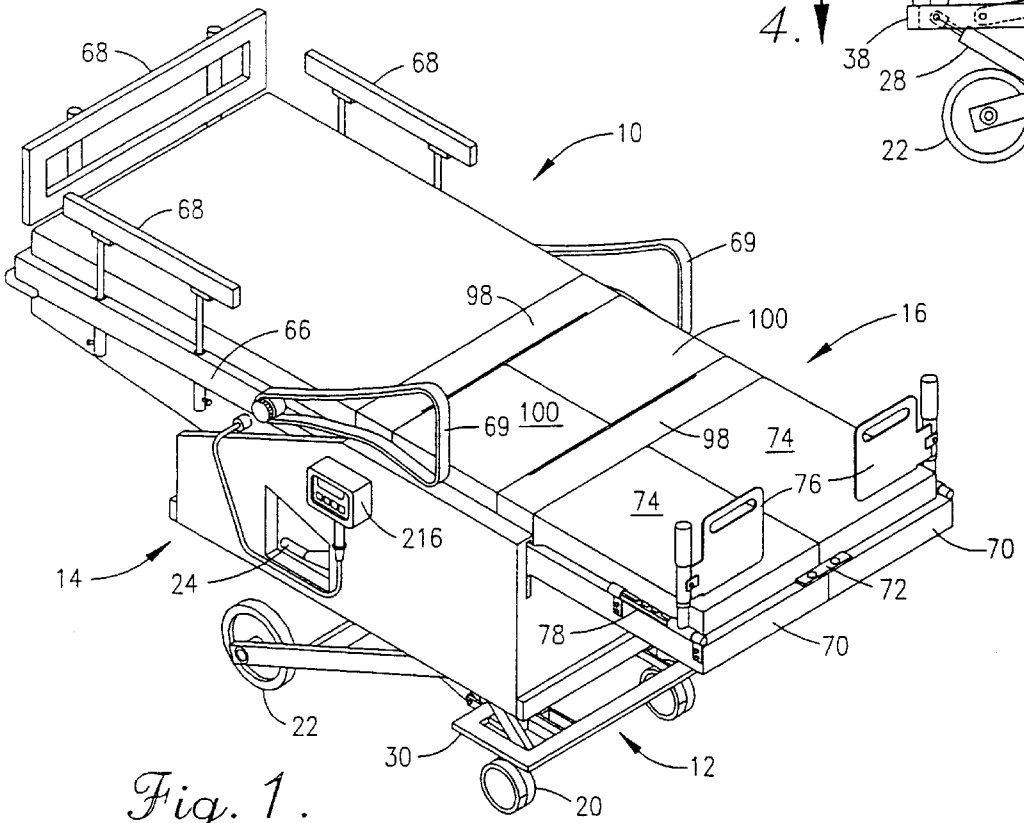
FIG. 1 is a perspective view of a bed according to the present invention in the reclining position.
Figures 2, 5, 6, 7:
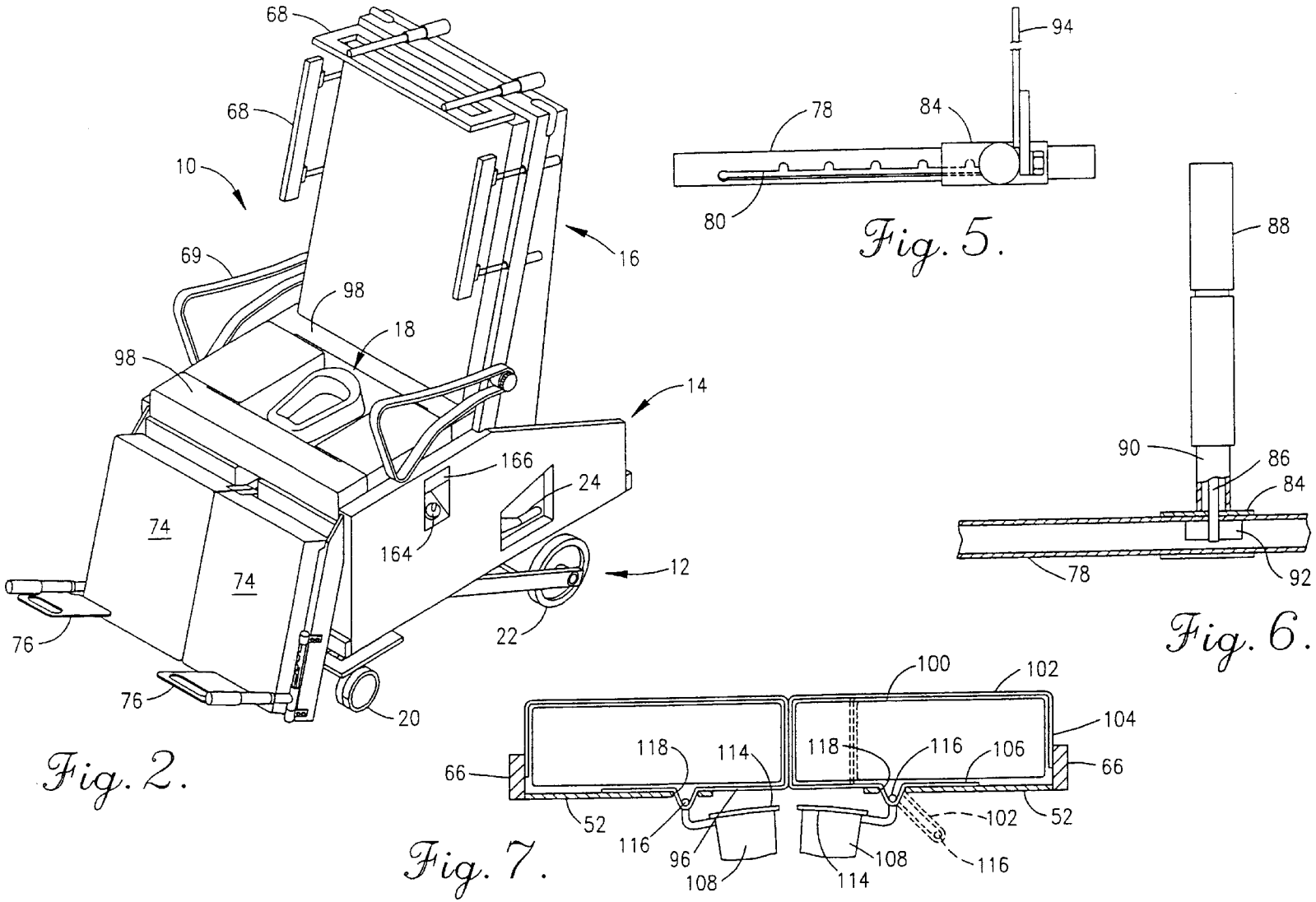
FIG. 2 is a perspective view of the bed of FIG. 1 in the upright position.
FIGS. 5 and 6 are partial top and side views, respectively, of a foot rest according to the present invention.
FIG. 7 is a cross-sectional view (in the closed position) showing the operation of the seat section for waste disposal.

With reference to FIGS. 1 and 2, a bed according to the present invention is generally designated by reference numeral 10. The bed generally includes a lift mechanism sub-assembly 12 which rests upon the ground, a main frame 14 supported on the lift mechanism, a patient support assembly 16 mounted on the main frame, and a waste disposal system 18 (FIG. 2), also mounted within the main frame. Each of these items will be discussed in order.

Figure 3:
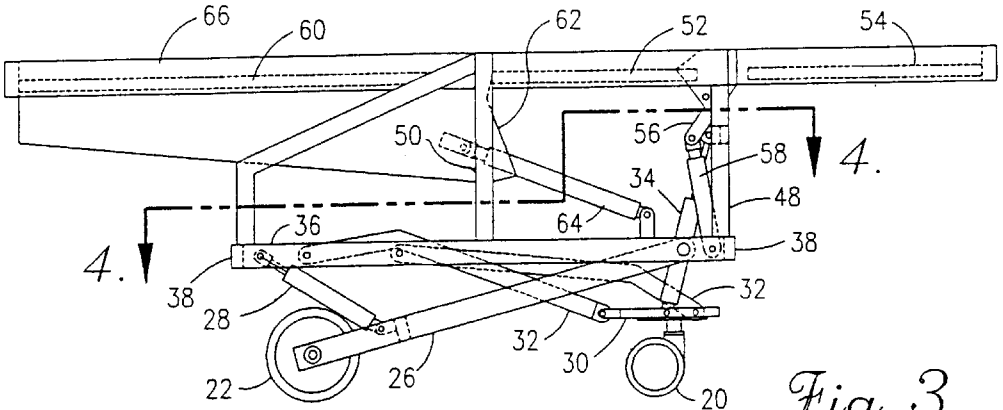
FIG. 3 is a schematic side view showing the linkages permitting movement of the bed sections.

With further reference to FIGS. 2 and 3, the lift mechanism 12 is shown in detail. The mechanism 12 will preferably permit movement of the bed 10 with respect to the ground, and therefore preferably includes a set of front wheels 20 and a set of rear wheels 22. At least one of these sets of wheels, preferably the front set, individually rotate about a vertical axis for steering. The wheels also preferably include a prior art locking mechanism to prevent their swivel and rotation thus securing the bed. The locking mechanism is preferably accessible by one or more locking levers 24 (FIGS. 1 and 2) recessed mounted on the exterior of the main frame.

The lift mechanism 12 also permits the main frame to be placed in various positions. For example, Trendelenburg, reverse Trendelenburg, standard horizontal, and various heights within the standard horizontal are obtainable. To achieve this, the lift mechanism includes various linkages connecting the wheels 20 and 22 to the main frame 14.

In particular, the rear wheels are connected to a rear end of a pivot bar 26, with the front end of the pivot bar being pivotally connected to the main frame near the front end thereof. To permit rotation of the pivot bar, linear expansion members 28 (such as hydraulic or air cylinders, electric linear motors, etc.) are connected at a first end to the main frame, and at a second end to the pivot bar 26 at a position spaced from the pivotal connection between the pivot bar and the main frame. As such, the degree of expansion or contraction of the member 28 will cause the pivot bar, and thus the rear wheels, to take various elevation positions with respect to the main frame.

In a similar manner, the front wheels 20 are mounted to a wheel frame 30, with the wheel frame being connected to the main frame via two sets of parallelogram bars 32. Additionally, linear expansion members 34 extend between the wheel sub-frame 30 and the main frame 14. As may be envisioned, expansion and contraction of the members 34 will thus cause the wheel frame 30, and thus the front wheels 20, to take various elevation positions with respect to the main frame.

The various elevation positions of the front and rear wheels with respect to the main frame may thus be used to attain the various bed positions. For example, maintaining the front wheels stationary (with members 34 extended), while drawing the rear wheels toward the main frame, (by contraction of members 28) will place the bed in the Trendelenburg position. Similarly, maintaining the rear wheels stationary while drawing in the front wheels will provide the reverse Trendelenburg position for the bed. Finally, moving both the front and rear wheels may effect strictly vertical movement of the bed, to thus adjust the bed height.

The various bars 26 and 32 must of course move freely to effect these movements. To ensure this, each bar is placed in its own vertical plane. This is best shown in FIG. 4, which is a partial plan view taken along line 4—4 of FIG. 3, with the removed portion of the device being a mirror image.

Figure 4:
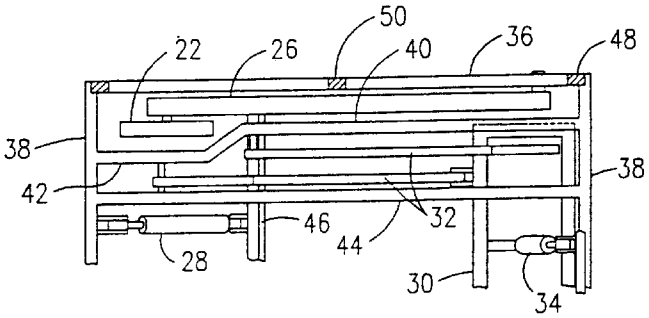
FIG. 4 is a partial schematic top view of the linkages of FIG. 3.

As shown in FIGS. 3 and 4, the main frame 14 includes a pair of side bars connected together at their ends by lateral bars 38. The pivot bars 26 are pivoted to the associated side bars 36 near the front of the side bars. Spaced inwardly from the side bars (and the pivot bars 26) are first support bars 40, again extending between the lateral bars 38. As is shown in FIG. 4, the support bars include a dog-leg or offset portion 42 adjacent the rear wheels 22. Spaced yet further laterally inward are secondary support bars 44, (part of mainframe) again extending between the lateral bars 38. Each set of parallelogram bars 32 is pivoted to the secondary bars. In particular, the forwardmost bar 32 is pivoted to the first support bar 40, while the rearmost bar 32 is pivoted to both the support bars 40 and 44. As may be seen, the relative pivot points on the support bars are respectively equally offset in the front-to-rear direction, with the rear bar 32 being pivoted rearmost, and in particular in the offset portion 42, hence forming the parallelogram linkage.

By this arrangement the various linkages and bars may move without restriction to provide the desired movement. To further assist in this movement the pivot bars 26 may be fixed together by a laterally extending wheel frame brace 46, which may advantageously be the attachment point for the linear expansion members 28.

The rectangular structure formed by the side bars 36 and lateral bars 38 may provide a support for vertically extending knee struts 48 and hip struts 50. As is best shown in FIG. 3, a thigh plate 52 may be fixed between the upper ends of the struts 48 and 50, to support the buttocks and thighs of the patient. Furthermore, the upper end of the knee struts 48 may serve as a fulcrum point for a leg plate 54 extending forwardly from the thigh plate. The leg plate may include a fulcrum arm 56 extending rearward from the fulcrum point, with a linear expansion member 58 connected between bracket 56 and the main frame 14. As such, expansion and contraction of the member 58 will cause rotation of the leg plate 54 with respect to the thigh plate 52, between a raised position shown in FIG. 3 and a lowered position shown in FIG. 2.

In a similar manner, there may be provided a back plate 60 pivoted to the upper end of the hip struts 50, and extending rearward to support the back and head of the patient. The plate 60 may be provided with a pivot bracket 62 extending downward from the pivot point, with a linear expansion member 64 extending between the bracket and the main frame. Expansion and contraction of the member 64 will thus cause rotation of the back plate with respect to the thigh plate, between a lowered position shown in FIG. 3 and a raised position shown in FIG. 2.

From the above description it may be seen that the bed may be moved between a flat bed-like position in FIG. 3, and a chair-like position shown in FIG. 2. Additionally, the leg and back plates may be moved independently to achieve numerous positions.

It is preferred that each of the back, thigh and leg plates include a raised peripheral lip 66 to retain mattress segments for each of the back, thigh, and leg plates. Mounted to this lip there may be appropriate retraining bars 68 to assist in retaining the patient, pillows, etc., on the surface of the device. As is known in the art, these restraining bars may be mounted for selective movement between raised and lowered positions. Similarly, there may be a pair of armrests 69 mounted to the lip at the rear of the thigh section, or to the forward end of the back section. The armrests may be placed in an operative position as shown in FIG. 1 where they operate as an additional restraint, and as shown in FIG. 2 where the operate as standard armrests. By release of a friction lock at the pivot point, the armrests may be pivoted approximately 180 degrees counterclockwise in FIG. 1 to an inoperative position.

While the above-described device is fully operative, various modifications are preferred for ease of use and patient comfort.

A first modification is a split leg feature. As is best shown in FIGS. 1 and 2, the leg plate 54 may be formed by two split plates 70 arranged in side-by-side relation. Both split plates share a common pivot shaft bridging between each outboard knee strut (and possibly a central strut which is not shown), and each is provided with its own expansion member 58. Each of the split plates may be rotated independently, such that a single leg may be supported in the raised position for medical purposes, while the other leg may be moved to the lowered position for patient comfort. In cases where this feature is to be avoided, there may be provided a locking plate 72 (FIG. 1) pivoted to one of the plates and movable between a released position allowing individual movement, and a locked position, shown in FIG. 1, secured by bolting to the other split plate. As may be envisioned, each of the split plates will mount an individual mattress segment 74.

As a further modification, each of the split plates may be provided with an adjustable foot rest 76, shown in FIGS. 1, 5, and 6. Each foot rest will include a longitudinally extending base rod 78 mounted near the free end of each split plate at the outboard edge. The base rods are hollow, and include an adjustment slot 80 extending longitudinally, with the slot 80 including several detent positions 82. Mounted for sliding movement over the base rod is a mounting sleeve 84, which includes a radially extending through hole (not shown) which may be aligned with the slot 80. The foot rest further includes a threaded shaft 86 having at its upper end an enlarged manual handle 88. The lower end of the shaft extends freely through a rotating sleeve 90, and through hole in the mounting sleeve 84, and is engaged with a friction locking block 92 within the base rod 78.

As such, rotating the handle clockwise will cause the friction block to apply a clamping force between pivot sleeve 90 and base rod 78 causing the foot rest assembly to become locked. Opposite rotation will release the clamping force, and permit sliding of the threaded shaft/sleeve 90 combination along the base rod to a new position. In this manner the footrest may be adjusted for different leg lengths.

Mounted upon the pivot rod 90 is a planar foot support 94. The foot support may be fixed to the pivot sleeve 90, but preferably is mounted for rotation about the pivot sleeve. as such, the foot support may be placed in an operative position as shown in FIGS. 1 and 2, where the supports 94 extend inboard toward each other to form a platform upon which the patient's feet may rest, especially in the chair configuration of FIG. 2. Alternatively, the foot supports may be rotated 90 degrees toward the head of the bed, and are in an inoperative position. It is noted that the foot rests may advantageously be used not only for supporting the patients feet, but may also serve to lift and support a sheet and/or blanket above the toes of the patient, eliminating pressure on the toes caused by the sheet.

A further modification for the device is the provision of a commode feature.

For this feature the thigh plate 52 is provided with a centrally located opening 96 (FIG. 7). To the front and rear of this opening the thigh plate may be provided with standard mattress pads 98. Over this opening, however, there are provided two retractable mattress sections 100, arranged in lateral side-by-side relation. These pads 100 may be filled with a resilient material, such as foam, or may be selectively inflatable. In either event, the pads are capable of contraction and expansion.

To effect or assist in this expansion and contraction, a belt 102 is associated with each pad. Each belt 102 at least partially surrounds the associated pad, and is secured to the adjacent main frame raised peripheral lip. In the preferred embodiment, each belt is a strip of material having a first end secured to the lip 66 at a first end 104, extending laterally across the pad, down across the laterally interior face of the pad, and then laterally below the pad where a second end 106 of the strip is secured to the thigh plate 52. The actual attachment of the belt to the lip and/or plate 52 may be selective as by hook-and-loop fasteners, or may be by other easily removable fastening devices.

Figure 8:
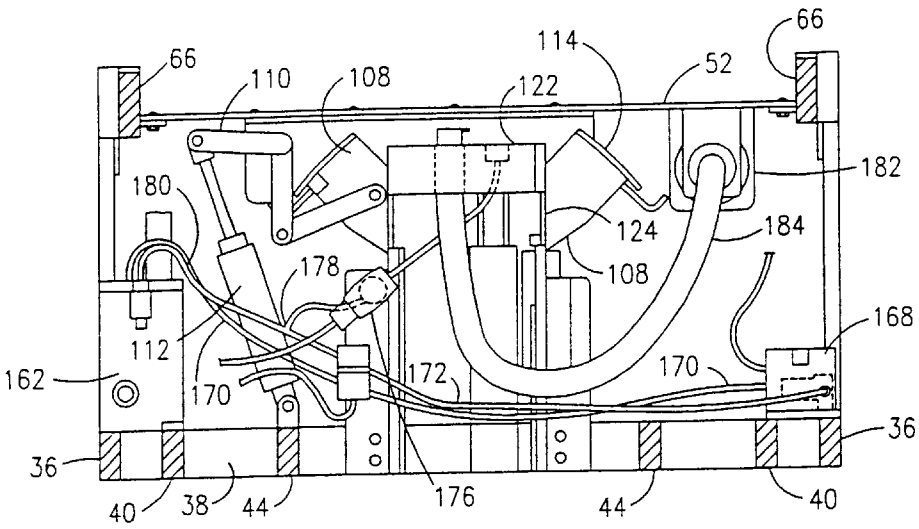
FIG. 8 is a rear view showing the waste disposal mechanism (in the open position) and cleansing and drying means.

Below the opening 96 in the thigh plate 52 there are mounted a pair of actuators 108. As is best shown in FIG. 8, the actuators are arranged in laterally side-by-side relation, with one actuator associated with each mattress pad 100. Each actuator is pivoted at its lower end to the main frame to enable rotation motion about a longitudinally extending axis. The upper end of each actuator is connected to a means for pivoting the actuator, which in the embodiment shown includes a linkage 110 and a linear expansion member 112 (one set removed for clarity). As may be envisioned, expansion and contraction of the member 112 will thus cause the actuators 108 to rotate between a closed position shown in FIG. 7 and an open position shown in FIG. 8.

The upper face of each actuator is provided with a convex formed plate 114, such that the two plates may act jointly to support the laterally interior sections of the pads 100 when the actuators are in the closed position, as shown in FIG. 7. Additionally, near the upper end of each actuator there is mounted a roller 116. In the closed position, this roller will be located below a slot 118 in the thigh plate 52 laterally exterior to the opening 96. The band 102 is passed through this slot and wrapped about the roller 116. From the dashed line in FIG. 7, it may be seen that when the actuators are moved to the open position the roller moves with the actuator, and thus draws the band 102 downward. This drawing of the band causes the associated pad to be compressed laterally outward, thus exposing the opening 96 in the thigh plate. Additionally, the actuators are moved to the open position, thus removing the convex formed plates from their position below the opening. Due to the resiliency of the pad, when released, an opposite force will of course cause the pads to close to their original position.

It is noted that the pads are located above the opening 96, with the convex formed plates 114 of necessity being spaced below the level of the thigh plate 52. As such, during closing of the mattress pads (which is achieved without the intervention of mechanical devices) there is little or no possibility of a portion of the patient's body being pinched between two rigid members, but only between the soft mattress pads. This clearly avoids potential injury to the patient.

As a further safety feature, it may be desirable to form the mattress pads 100 as the known variably inflatable type. In this manner the inflation of the pads may be increased during closing to assist in the closing, but additionally to lift the patient upward away from the closing action. In this regard it may be desirable to continue inflation until the pads are overinflated from the normal setting, and then reduce the inflation after the closing operation is complete. In a preferred embodiment of this invention, the seat is closed pneumatically. It will be appreciated that the seat could be closed hydraulically by a reversal of the hydraulic action used to open the mattress pads. During operation of the commode feature of the present invention, the seat is held open by the hydraulic blocking valve which is energized so as to provide a holding force for holding the mattress pads open. In order to close the mattress pads pneumatically, the blocking valve is energized in a manner for releasing the holding force of the hydraulic cylinder. After the hydraulic cylinder is emptied, thereby releasing the holding force, the mattress pads are pneumatically inflated. The location of bladders within the mattress pads are arranged such that, upon inflation, the mattress pads drive inwardly towards the center of the opening.

Figure 9:
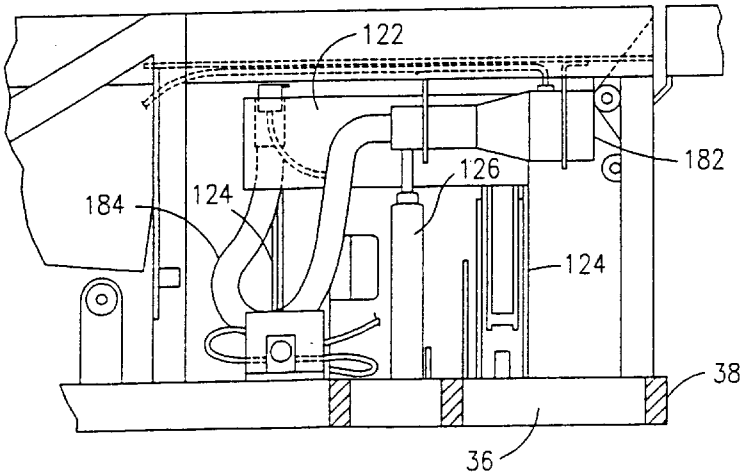
FIG. 9 is a side view of the mechanism of FIG. 8.

When the actuators are in the open position it may be seen that the thigh section is fully open to the main frame therebelow. It is in this position on the main frame that there is mounted a commode unit 120. The commode unit may be of any known type, and will typically include a lifting mechanism for raising and lowering the unit to interface with the patient. This lifting mechanism may include a platform 122 (FIGS. 8 and 9) to directly mount the commode unit, with the platform being supported by one or more linear bearings 124 or slide mechanisms mounted to the main frame to permit the vertical movement of the platform. This vertical movement may then be effected by a linear expansion member 126 mounted between the main frame and the platform. As may be envisioned, the commode unit may thus be placed in a lowered position when the actuators and mattress pads are closed, and raised to interface with the buttocks of the patient when the actuators and mattress pads have been opened. A pressure sensor is utilized in the hydraulic line between the hydraulic manifold and the hydraulic extension cylinder utilized in the lifting mechanism. The pressure sensor may be fitted within the line in known manners, with the preferred embodiment comprising a T-fitting in the hydraulic line. The pressure sensor is utilized to stop the commode lifting mechanism after it engages with the buttocks of the patient. In the preferred embodiment, the pressure sensor is calibrated to provide approximately two pounds of force around the circumference of the commode rim top. Utilization of the pressure sensor in this manner creates a seal between the patient and commode to prevent patient waste and/or bidet water from soiling the surrounding mattress and sheet. In operation, once the selected amount of pressure is reached (e.g., two pounds), an electric signal is sent from the sensor to the solenoid to close the solenoid and thereby turn off the hydraulic pump.

Figure 10:
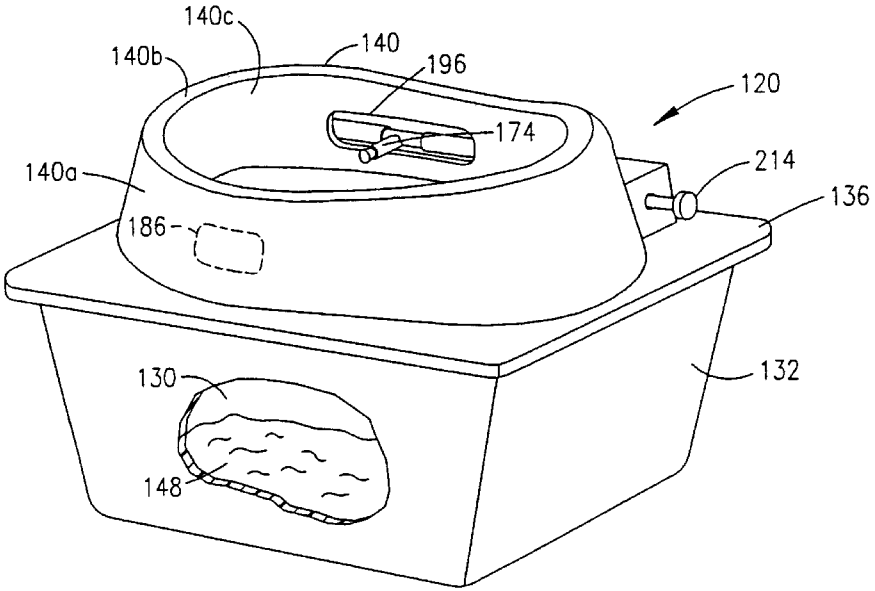
FIG. 10 is a perspective view of a waste canister according to the present invention.

While various commode units may be employed, a preferred arrangement is shown in FIGS. 10–13. With reference to FIG. 10, the commode unit 120 includes a housing 128 which defines a cavity 130 for receiving the waste from the patient. This preferred unit is disposable, and includes a base 132 in the form of a generally rectangular upwardly concave member having at its upper edge a peripheral lip 134. This base is preferably molded as a single item.

Mounted to the base is a cover 136. The cover 136 includes a peripheral lip 138 conforming to the lip 134, such that the lips 134 and 136 may be secured together, as by thermal or ultrasonic bonding, adhesives, etc. The cover also includes an upwardly extending engagement rim 140 formed by an upwardly extending outer wall 140*a* and an upper face 140*b*. The clear demarcation between wall 140*a* and face 140*b* shown in the figures is of course illustrative, and these two elements may be formed as a smooth transition with greater curvature and less definition between them. The rim may take a peripheral form or shape similar to a standard toilet seat, and will typically extend rearward a sufficient distance to adequately encompass the anus and forward a sufficient distance to encompass the urethra or penis, such that the patient may both defecate and urinate within the confines of the rim, with the waste being retained within the cavity 130. As with the base, it is preferred that the rim 140 and lip 136 be formed as a monolithic unit by molding.

Figure 11:
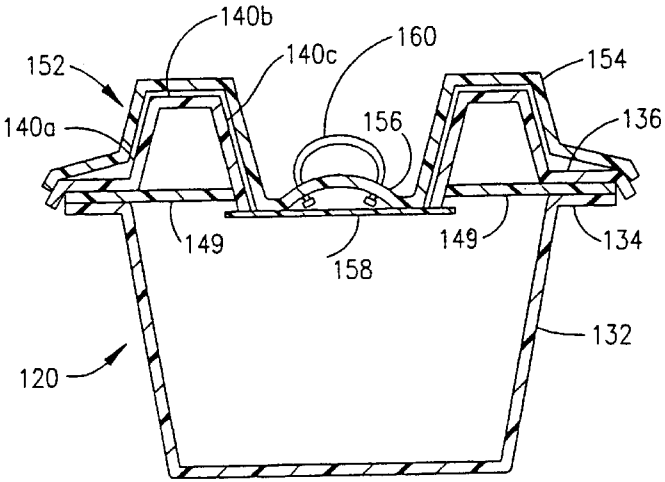
FIG. 11 is a cross-sectional view of the container of FIG. 10 with a lid attached.

In some instances it may be preferred to include a barrier plate 149 near to, but spaced upwardly from, the inner edge of the upper face 140*b*, as shown in FIG. 11. This barrier plate serves to form an air channel between the inner and outer walls of the rim 140 and the barrier plate. Such an air channel can be advantageous as described more fully below.

Figure 12:
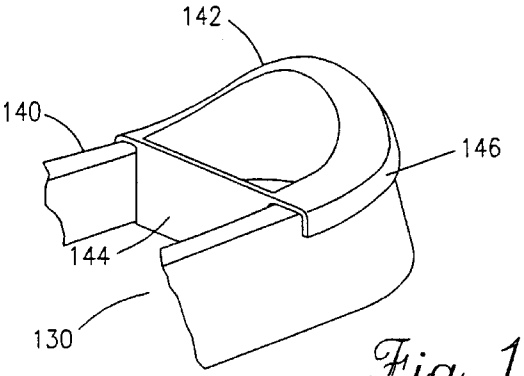
FIG. 12 is a detail view of a urine sample collector according to the present invention.

As shown in FIG. 12, a urine sample container 142 may additionally be provided. Such a container would include a receptacle or cup portion 144 to receive the urine, and a hook or coupling section 146 adapted to engage with the forward end of the rim to retain the container 142 in position. While the container 142 has been shown in the figures as conforming well to the rim 140, other configurations, such as a standard cylindrical cup with a pair of hook arms, could also be employed. As another example, a laterally extending wall could be formed in the base 132 to divide the cavity 130 into a rear section for fecal matter and a forward section for urine.

Figure 13:
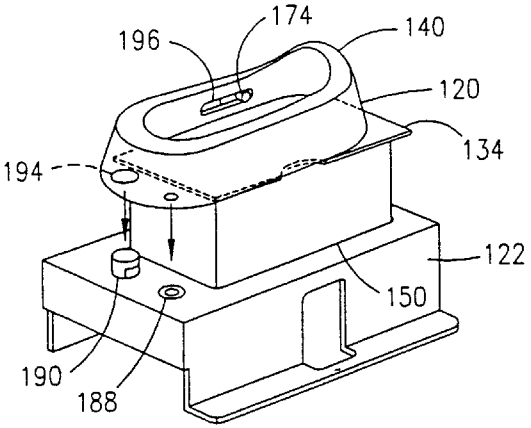
FIG. 13 is a perspective view of the mounting and interface connections of the container of FIG. 10.

As may be seen from the above description, the commode unit is readily suited for use as a disposable unit for increased convenience and sanitation. Specifically, as is best illustrated in FIG. 13, the base 132 of the commode unit may be received within an opening 150 in the platform 122, with the peripheral lip 134 resting upon the base. This will provide adequate support for the commode unit on the platform, but will permit the commode unit to be easily removed from the platform by manually lifting the commode unit upward. The used commode unit may then be disposed of, and a new unit inserted into the platform. This operation is of course performed when the mattress pads are in the open position to permit access to the commode unit.

To aid in the removal of the used commode unit, it is preferred that the commode unit be provided with a safety lid, generally designated by reference numeral 152 (FIG. 11). The safety lid 152 preferably includes a peripheral section 154 which conforms at least to the rim 140. As is shown in FIG. 11, it is most preferred that this peripheral section closely conform to the outer wall 140*a* and upper face 140*b* of the raised rim 140, and to the lip 136.

Within this peripheral section the lid 152 includes a depressed central region 156 conforming in shape to the inner edge of the upper face 140*b*. However, this central region is slightly larger than this inner edge, such that the central region 156 may be locked below the upper face 140*b* to form an interference fit, as shown in FIG. 11. This interference fit may be achieved simply by forcing the lid downward upon the commode unit, with the resilience of the rim 140 and/or the central region permitting the central region to pass below the inner edge into the locked position. as may be envisioned, this interference fit will secure the lid in place, as well as provide a further seal against egress of the contained waste.

In the preferred form shown in FIG. 11, rim 140 further includes an inner wall 140*c* extending downward from the upper face 140*b*, for reasons described below. Where this is the case, the central region 156 will of course also be depressed such that the interference fit may be achieved below the edge of the inner wall. Additionally, for reduced cost and increased structural integrity, it is preferred that the lid is formed as a molded unit, or at least mainly from molded units. However, such molding may make it difficult to form an enlarged section at the central region to provide the interference fit. To avoid this problem, the central region may be molded with a size to easily fit in the confines of inner wall 140*c*, but have a sheet of material 158 (such as plastic) secured to its lower face, with this sheet having the enlarged dimension to provide the desired interference fit.

For yet further convenience, it may be desired to provide a handle 160 upon the lid, such that the entire commode unit and lid combination may be lifted by the handle after the lid is secured in place. This not only assists in carrying the unit for disposal, but in lifting the unit from the opening in the platform 122 just after the lid is secured. In this regard it is noted that the handle should not cause a reduction in the integrity of the commode unit/lid combination. For example, if the handle 160 is formed by the known plastic strap having T segments at its end for insertion into appropriate holes, as shown in FIG. 11, the holes should not provide direct access to the cavity 130, but should be covered and sealed by the sheet 158.

As a further preferred embodiment for the device 10 and/or commode unit, odor control means are provided. While various vacuum devices could be used for channeling air from the cavity 130 of the commode unit, or various perfumes could be injected into the cavity, it is preferred that the cavity 130 contain a gelling agent 148 (FIG. 10) to encase the waste. One preferred agent is Sodium dichloroisocyanurate in an organic matrix (available from Safetec of America, N. Tonawanda, N.Y., under the product name Red-Z). This material may simply be placed into the cavity 130 in its powder form prior to initial use of the commode unit. During use by the patient the moisture in the fecal matter and urine will cause swelling and gelling of the material 148. This action may, in itself, be sufficient to cause the fecal matter and urine to be completely encased within the material. If this is not the case, the addition of a small amount of water to the commode unit (such as one cup) subsequent to depositing the waste will typically be sufficient for encasement of the waste. Once thus encased, the odor from the waste is eliminated. By providing a sufficient amount of the gelling material, such as approximately 21 grams, prior to initial use, the gelling action may be repeated for several uses of the commode unit with adequate encasement of each new waste input.

Another preferred variation for the device 10 is to provide cleansing means for washing and drying the patient's anal (and/or genital) region after using the commode unit. Various prior art mechanisms for this purpose are known, and are roughly similar to a bidet. These prior art arrangements could be used with the present device and commode unit. However, it is preferred that the device 10 be provided with an inventive patient cleansing means.

A first component of this cleansing means is a water storage tank 162 (FIG. 8) mounted to the main frame below the patient. This tank will hold a sufficient amount of water for several washing cycles, with the number of cycles preferably corresponding generally to the number of uses possible with the gelling agent 148. A water fill inlet 164 (FIG. 2) is provided at a convenient location on the exterior of the device 10, and is connected to the tank 162. The tank may include an appropriate water level sensor (not shown), and the device may include a set of indicator lights 166 operatively connected to the sensor. As examples, the indicator lights could include a tank water level low indicator, and a tank water level high indicator, to provide a simple visual indication of these conditions. Additionally, the indicator lights 166 may include a commode unit full indicator light which is activated upon a predetermined number of operations of the washing cycle, typically corresponding to the number of uses feasible with the gelling agent. Commode unit full indication may also be activated by an increase in weight. Current configuration includes a weight sensor (mechanical spring) calibrated to a predetermined value to provide an indication when the unit is approximately two-thirds full.

The cleansing means will also include a water pump 168 (FIG. 8) connected to the tank via an inlet line 170. An output of the pump is of course connected to an outlet line 172, which is connected operatively to a spray nozzle 174 (FIGS. 10 and 14) associated with the waste receptacle or commode unit 120, such that the spray nozzle will produce a fountain of water which may impinge upon the anal region of the patient after use of the commode.

One inventive aspect of this arrangement is a novel heating arrangement for this water, to provide patient comfort.

In this regard, the water tank 162 is provided with a thermostatically controlled heater (not shown) for maintaining the water within the tank at a predetermined temperature. However, such a heater will not have an appreciable affect upon the water naturally retained within the lines 170 and 172 and in the pump, which would normally result in the nozzle ejecting cold water until the heated water reaches the nozzle.

Figure 15:
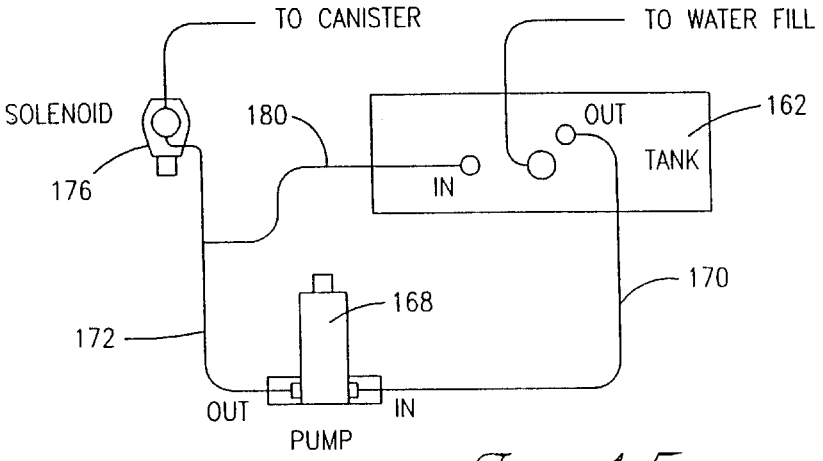
FIG. 15 is a schematic depiction of a water supply arrangement according to the present invention.

To avoid this problem, the outlet line 172 is provided with a solenoid actuated valve 176. Additionally, the output line 172 includes a T connection 178, with one branch of the T providing normal flow through the output line, but the other branch connecting to a recirculation line 180 connected to the tank 162. This is illustrated schematically in FIG. 15. The T connection is located upstream of the valve 176, and the lines and valve 176 are vertically arranged such that, upon cessation of the pump operation, gravity will cause the water level in the output line to fall below the vertical level of the valve 176.

In operation, valve 176 is normally closed, preventing flow to the nozzle 174. The pump will draw water through the inlet line, and will attempt to force water through the outlet line. However, since the valve 176 is closed, all flow will pass through the second branch of T connection 178, recirculating the water to the tank 162. This will continue for a predetermined time sufficient to fill the lines with heated water from the tank, as opposed to cold water which had been sitting in the lines. After this time period the valve 176 is opened, and flow will pass through the first branch of the T connection and thus to the nozzle 174 to provide the bidet.

It is noted that recirculating flow will continue during this time, but the pump provides sufficient pressure for both recirculation and nozzle spray. After a second predetermined time period the pump is deactivated and thus the nozzle spray is halted, with the valve 176 still remaining open. Gravity then causes the water level in the lines to drop below the level of valve 176. After a third predetermined time period sufficient for this drop to take place, the value 176 is closed, and the system is ready for another cycle.

As may be envisioned, the provision of cleansing means assists in hygiene and patient comfort. Additionally, the water expelled in this process may advantageously be used to activate the gelling material to encase the waste. Furthermore, the present cleansing means ensures that the patient will be provided with only warm comfortable water during this process.

As a further part of this process, the anal region of the patient may advantageously be coated with a surfactant lotion prior to initial cleansing, and after each subsequent cleansing. Such a surfactant will prevent the stool from sticking to the patients skin, and will greatly assist in removal of the stool from the anal region. This will reduce or eliminate the need for manual cleaning of the anal region, reducing possible discomfort to the patient, and reducing the risk of contamination by the stool.

As a compliment to the cleansing means, it is preferred that the device 10 also include drying means to dry the anal (and/or genital) region of the patient. To this end, the device may include an air blower 182 mounted to the main frame, preferably including a heater. The outlet of the blower is connected to a conduit 184 interfacing to the cavity 130 of the commode unit. In this manner, the air from the blower will circulate in the commode unit, thus impinging upon the anal region to assist in drying after cleansing. For those arrangements where the commode unit includes a rim similar to rim 140, the interior of such rim may be provided with appropriate ducts 186 (FIG. 10) to cause the air to more directly impinge upon the anal region for improved drying. As may be seen the ducts 186 are an outlet for the air channel defined by the walls of the rim 140 and the barrier plate 149.

While the above-described cleansing means and drying means may be employed with various commode systems, including those directly connected to a waste drain, it is also possible to employ these means with the preferred disposable commode unit 120. For example, as shown in FIGS. 8 and 13, the output line 172 from the water pump may be connected to a bulkhead fitting 188 mounted on the platform 122 of the lifting mechanism, with the bulkhead fitting being accessible from above. Similarly, the conduit 184 from the air blower may be connected to a diffuser or directing vane 190 mounted on the platform 122.

The commode units 120 may then be provided with a fluid stem fitting 192 (FIG. 14) mounted on the underside of the lip 134, and operatively connected to the nozzle 174. As may be envisioned, the placement of the stem fitting 192 is such that it will operatively engage with the bulkhead 188 when the commode unit is placed within the opening 150 of the platform. Similarly, the lip 134 and 136 may include an opening providing access to the space between the inner and outer walls of the rim 140, with this opening 194 surrounding the vane 190 when the commode unit is placed on the platform. By this arrangement the commode unit may be produced as an inexpensive disposable unit, yet still provide cleansing and/or drying means.

As yet a further refinement, it is preferred that the device 10 be provided with means for manually directing the nozzle for cleansing. This means could of course be provided on prior art bidet-type cleansing systems, but is described with reference to the preferred disposable commode unit.

Figure 14:
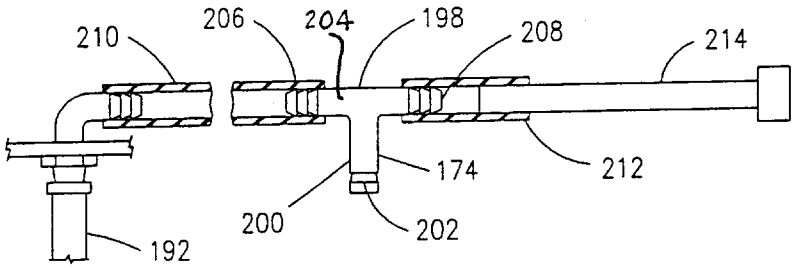
FIG. 14 is a detail view of a nozzle adjustment arrangement according to the present invention.

With reference to FIGS. 10 and 14, the inner wall 140*c* of the rim 140 is provided with a slot 196, typically elongated in the longitudinal direction, and having a width such that the slot is larger than the nozzle 174. A T connector 198 is then machined (or initially formed) to form the nozzle 174 from the base or stem 200 of such T. This may be effected by removing a section 202 of the T until the inner passageway therethrough is reached, and by plugging this passageway downstream of the removed section. This will cause water passing through the stem to exit at the removed section. It is this stem which extends through the slot 196 to form the nozzle.

The crossbar 204 of such T will then have a first end 206 and a second end 208. Connected to the first end 206 is a length of flexible tubing 210, which passes between the inner and outer walls of the rim 140 and is connected to the stem 192. The second end 208 of the crossbar is also connected to a piece of flexible tubing 212, but this piece is much shorter, and is connected to an elongated bidet handle 214. Both this second tubing 212 and a portion of the handle 214 extend between the inner and outer walls of the rim 140, but the free end of the handle 214 extends through an opening in the outer wall of the rim, such that it is accessible to the patient. This handle 214 is also either solid, or is plugged, such that water may not flow though the handle.

With this arrangement, water entering the stem 192 passes through the first tubing 210 and enters the T connector 198. A small portion of water will enter the second tubing 212, but further flow is halted by the handle 214. As such all further flow will pass through the stem 200 of the T and exit at the removed section 202, creating the fountain of water and defining the nozzle 174. Furthermore, since the nozzle is smaller than the slot 196 through which it extends, the user may manually grasp the handle 214 and move the handle to the front and rear, and rotate the handle about its longitudinal axis, thus causing similar movements in the T connector and thus the nozzle 174. In this manner the patient may direct the fountain of water to achieve the desired cleansing with minimal body movements.

Where the commode unit is of the disposable variety as shown, and employs the described lid 152, such a lid would preferably encompass or enclose the handle extending from the rim 140. This may reduce the integrity of the sealed unit, or may simply increase the cost of forming the lid. To avoid this problem the attendant may simply grasp the handle 214 and pull outward, thus disengaging the handle from the tubing 212. The handle may then be placed in the cavity 130 of the commode unit prior to applying the lid. This can serve a further function, in that removing the handle may permit the nozzle 174 to be drawn or pushed between the walls of the rim 140 such that the nozzle does not prohibit movement of the central portion of the lid into the desired interference position.

For the various bed positioning and cleansing functions described above, there must of course be some control means for permitting the user to initiate and control these functions. In prior art patient bed systems it has been known to provide a handheld remote control, and this is also preferred for the device 10.

Figure 16:
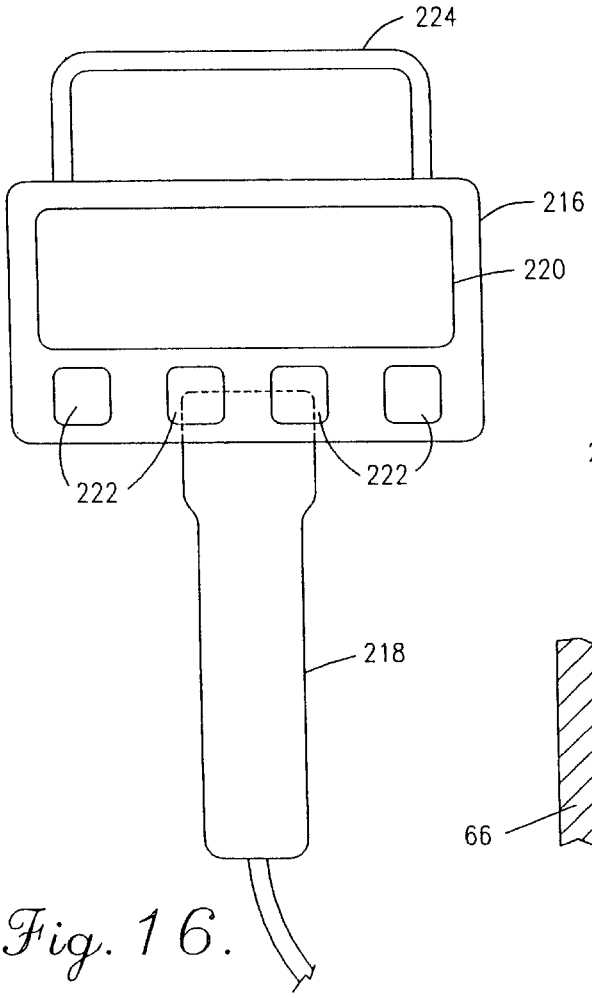
FIG. 16 is a front view of a controller device according to the present invention.

With reference to FIG. 16, there is shown a controller 216 according to the present invention. The controller includes at least a hand grip section 218 ergonomically adapted to be held in the human hand, a display screen 220, and several buttons 222, preferably designated numbers 1–3 from the left to right and clear entry/clear.

The controller includes, or is connected to, various memory and logic chips (not shown) which in turn produce signals to activate various expansion members, pumps, and blowers. These chips also interface the display screen and buttons to permit the user to access the various functions. In this regard it is preferred that the display screen provide a menu system for various functions. For example, a main screen could appear as:

| | |
|---|---|
| PATIENT CHOICES: | 1. ADJUST BED<br>2. USE COMMODE<br>3. ADJUST MATTRESS |

As may be envisioned, by pressing one of the associated buttons 222 a further menu would appear. For example, pressing the "one" button for bed adjustment could summon the menu:

| | |
|---|---|
| ADJUST BED: | 1. HEAD<br>2. FOOT<br>3. BED/CHAIR |

Again, pressing the appropriate button could summon a further menu with the choices being "up" or "down", or "bed" or "chair".

In a similar manner, depressing the main menu number of mattress adjustment could summon a further menu to choose between the head or seat mattress, with either of these choices resulting in a further menu where the choices would be "harder" and "softer". While not an important aspect of this invention, the various mattress segments could be provided with variable inflation means for varying the firmness of the mattress segments, as is known in the art, and it is this inflation means which would be ultimately controlled for adjusting the mattress.

The remaining choice from the initial menu was "use commode". Selecting this item could summon a further menu such as:

| | |
|---|---|
| COMMODE MENU: | 1. OPEN OR CLOSE<br>2. WASH AND DRY<br>3. DRY AGAIN |

Selecting the first menu item would of course open the mattress pads 100 and raise the commode unit, or, if already raised, would lower the commode unit and close the mattress pads. In this regard it is preferred that the device 10 be provided with a speaker and stored messages to provide an audible warning such as "caution: the seat is about to open" or "caution: the seat is about to close" at the beginning of each respective operation.

Selecting the second menu item, "wash and dry" would activate the water pump, solenoid valve, and air blower in the manner described above. In this regard, it is preferred that the number of times this selection is made is stored in memory for use in controlling the indicator light 166 associated with replacing the commode unit. Additionally, it may be desirable to permit this choice only once per raising of the commode unit, to prevent wasting of water and commode units (due to using all of the gelling agent, if provided).

The third menu item is "dry again", and simply activates the air blower for a preset period of time as with the automatic activation following washing. It is preferred that there be no limit to the number of drying cycles permitted.

While the above menu items are those typically used by the patient, the controller may also provide specialized menu selections intended for use only by the care provider. Such specialized menus may be summoned by pressing a predetermined button sequence, such as "clear", "3", "clear", "1". An example of such a menu would be:

| | |
|---|---|
| NURSES MENU: | 1. CPR<br>2. Trendelenburg<br>3. OTHER |

Selecting the first menu item could automatically place the device in a predetermined position, such as flat bed, and/or cause high mattress inflation for a very firm mattress. The second menu item would summon a further menu permitting a choice of the regular or reverse Trendelenburg positions described above. This "Trendelenburg" selection could also provide a menu selection for bed height adjustment, in turn summoning a menu with selections for "up" and "down".

The final main specialty menu selection is "other". This could of course lead to various other menu selections, but one of importance could be "replace canister". Selecting this item would cause the mattress pads to open, permitting access to the commode unit. Additionally, this selection could reset the counter for uses of a particular commode unit, for use in controlling the indicator light 166 noted above.

Alternatively, the controller may include a menu system that is audible in nature. In this regard, as an alternative embodiment to the controller as just described, a selected button may be depressed whereupon the first item in the main menu is audibly output through a speaker in the controller. If the output is indeed the selection the patient desires, a second selected button may be depressed to choose that menu option. Alternatively, the first button may be depressed to advance the audible menu to the next item in the main menu, and so forth and so on. Upon activation of the second selected button, thereby indicating a selection of the desired menu option, a submenu may be audibly output in the same manner. Upon selection of the ultimate option, third and fourth buttons 222 are utilized for control.

For example, a patient desiring to adjust the bed may access the main menu by depressing a first selected button 222 on controller 216. Upon depressing the first selected button 222, words such as "ADJUST BED" are audibly output from a speaker (not shown) in the controller 216. Since this is the option desired by the patient, a second selected button 222 is depressed to make the selection and to produce a signal indicative of the selection. The controller audibly outputs an appropriate instruction to the patient. In this case, such an instruction would advise the patient to access a submenu by depressing the first selected button. Upon doing so, the patient would access a submenu whereupon, for instance, the words "ADJUST HEAD" would be audibly output from the controller 216. Assuming the patient wishes to adjust the foot portion of the bed, the patient would then again depress the first selected button 222 to advance the menu to the next option. The patient could continue to operate controller 216 in this manner until the desired option was reached, whereupon the second selected button is depressed to generate a signal indicative of the selection. In this example, once the patient has made the appropriate selection to adjust the foot portion of the bed, further instructions would be audibly output to advise the patient how to operate the controller. Particularly, the patient would then utilize third and fourth selected buttons 222, for instance, to control up and down functions, respectively, of the foot portion of the bed.

As a further convenience the controller may be provided with a hanger device 224 such that the unit may be placed in a convenient location when not in use. Additionally, there may be provided a base 226 mounted to the main frame for storing the controller. This base may include a recess in its upper face adapted to receive a portion of the controller, such as an enlarged display/button portion. To permit the display to be easily read by a care provider, it is preferred that the display thus face upward when in the base 226. This could result, however, in the handle portion 218 extending outward and creating an obstacle.

Figure 17:
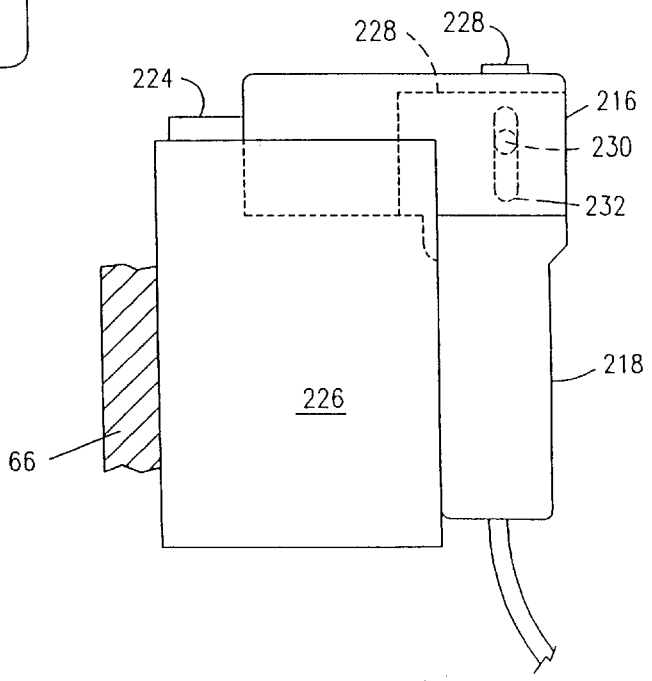
FIG. 17 is a side view of the controller device of FIG. 16 in a storage configuration.

To avoid this problem, it is preferred that the enlarged display/button section include a recess 228 which receives the handle section 218. This recess will receive the handle section in the usual extending configuration shown in FIG. 16, and rotated 90 degrees to a storage position shown in FIG. 17. To maintain the handle in one or the other configuration, a rod 230 connected to the display/button section and passing through the recess may be received within a slot 232 in the handle section 218. A spring (not shown) placed in the slot (above the rod 230 in FIG. 17) would thus bias the handle section into abutment with the recess 228 in either position, securing the handle against unintentional movement, but permitting manual movement between the positions.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. In a patient support having a waste disposal system and a water tank for heating and storing heated water, a water pump for drawing water from said tank and supplying said water to a nozzle operatively connected to said tank for providing a cleansing spray to the anal region of the patient, the improvement comprising:

a valve located intermediate said pump and said nozzle;

a recirculation conduit for permitting flow of said water from said pump to said tank;

control means for closing said valve during initial operation of said pump to cause recirculation, and for opening said valve after the water supplied by said pump has a temperature substantially equal to that of said water within said tank; and a commode provided on said patient support for receipt and storage of feces and/or urine, said commode being a replaceable unit;

an air blower having an output, a conduit connected to said output of said air blower, with said conduit directing air expelled by said blower to said commode and thus an anal region of the patient; and said patient support including a vane operatively connected to said conduit, and said commode further including an air channel removably engaged with said vane and an air outlet operatively connected to said air channel.

2. The improvement of claim 1, wherein said nozzle is mounted upon said commode, said patient support including a fitting operatively connected to said water supplied by said pump, and said commode further including a stem removably engaged with said fitting, said stem being operatively connected to said nozzle.

3. The improvement of claim 2, wherein said nozzle is mounted to said commode for movement, and further including a manual handle connected to said nozzle such that movement of said handle causes movement of said nozzle.

4. The improvement of claim 3, wherein said commode includes a cavity for receipt and storage of feces and urine, and further including an initially powdered gelling agent within said cavity, said agent being activated by moisture.

5. The improvement of claim 1, wherein said valve is located vertically below said nozzle a sufficient distance such that upon deactivation of said pump said water above said valve will fall by gravity to a level below that of said valve.

6. The improvement of claim 1, wherein said nozzle is mounted upon said commode.

* * * * *